US007850141B2

(12) United States Patent
Moulin et al.

(10) Patent No.: US 7,850,141 B2
(45) Date of Patent: Dec. 14, 2010

(54) RETAINER APPARATUS

(75) Inventors: Arnaud Claude Bruno Moulin, Veauche (FR); William Floyd Reed, Denver, CO (US)

(73) Assignee: MOB Outillage SA, le Chambon Feugerolles (FR)

( * ) Notice: Subject to any disclaimer, the term of this patent is extended or adjusted under 35 U.S.C. 154(b) by 884 days.

(21) Appl. No.: 11/737,503

(22) Filed: Apr. 19, 2007

(65) Prior Publication Data

US 2008/0258038 A1 Oct. 23, 2008

(51) Int. Cl.
*E04G 17/06* (2006.01)

(52) U.S. Cl. ..... 249/216; 249/4

(58) Field of Classification Search ..... 249/210, 249/34, 216, 21, 213, 208, 8, 4
See application file for complete search history.

(56) References Cited

U.S. PATENT DOCUMENTS

| | | | | | |
|---|---|---|---|---|---|
| 733,396 | A * | 7/1903 | Jarvis | 249/9 |
| 1,331,491 | A * | 2/1920 | Ferguson | 269/203 |
| 1,495,659 | A * | 5/1924 | Williamson | 52/677 |
| 2,815,778 | A * | 12/1957 | Holman | 269/170 |
| 2,868,250 | A * | 1/1959 | Holmboe, Sr. | 269/208 |
| 3,207,465 | A * | 9/1965 | Papin | 249/34 |
| 4,066,237 | A | 1/1978 | Bentz | |
| 4,247,073 | A | 1/1981 | Vario | |
| 4,340,200 | A * | 7/1982 | Stegmeier | 249/3 |
| 4,635,895 | A | 1/1987 | Johnson, Jr. et al. | |
| 5,234,654 | A | 8/1993 | Brooks | |
| 5,343,667 | A | 9/1994 | Peden | |
| 6,173,937 | B1 | 1/2001 | Cottongim | |
| 6,234,447 | B1 | 5/2001 | Boyden et al. | |
| 6,450,489 | B1 * | 9/2002 | Wang | 269/6 |
| 6,536,737 | B1 * | 3/2003 | Davis | 249/3 |
| 6,918,567 | B2 | 7/2005 | Ward et al. | |
| 7,076,925 | B2 | 7/2006 | Gagliano | |
| 7,144,530 | B2 | 12/2006 | Ward et al. | |
| 2007/0069104 | A1 | 3/2007 | Morin | |

* cited by examiner

*Primary Examiner*—Darnell M Jayne
*Assistant Examiner*—Timothy M Ayres
(74) *Attorney, Agent, or Firm*—Roger A. Jackson

(57) ABSTRACT

A retainer apparatus and method is disclosed for retaining a form mold in a selected position that includes a beam having a longitudinal axis and a retaining member slidably engaged to the beam allowing for free movement along the longitudinal axis when said retaining member is in a free state. The retaining member has a lengthwise axis substantially perpendicular to the longitudinal axis in the free state, with the retaining member also including a leg substantially parallel to the lengthwise axis, the leg extending from the slidable engagement and terminating in a form mold interface portion. The retaining member also including a head portion extending from the slidable engagement being substantially oppositely disposed from the leg. The retainer apparatus is place into the locked state by applying a force to the leg to substantially lock the slidable engagement and retaining the form mold.

5 Claims, 15 Drawing Sheets

RETAINER APPARATUS

TECHNICAL FIELD

The present invention generally relates to a retainer apparatus for a mold and more particularly to a retainer apparatus that can bracket, clamp, or separate portions of a mold, wherein the retainer apparatus can quickly, efficiently, and easily be put into a locked state of engagement to support the mold portions and subsequently be quickly, efficiently, and easily be put into a free state of disengagement to be removed from the mold portions.

BACKGROUND OF INVENTION

It is customary practice in the construction industry related to the forming of a concrete structure to rely upon a mold of some type to form a desired volumetric cavity for the concrete to be disposed into and thus the concrete curing into the desired shape to form a concrete structural element. This necessitates the creating or assembling of a number of various molds in a multitude of desired shapes and then subsequently disassembling these molds after the concrete has been disposed into or poured into the uniquely shaped mold and cured sufficiently after some passage of time. Thus, in the construction industry related to the forming of a desired concrete structural shape there is considerable repetitive assembly and disassembly of the molds leading to the desire on the part of the construction industry to make this mold assembly/disassembly process as easy as possible. Breaking this down further on this easy mold assembly/disassembly issue it would be further desired that a minimum of time is required, a minimum of tools are required, and a minimum of waste (i.e. consuming disposables) is created.

As an example, in concrete flatwork wooden stakes are used to laterally retain the mold side edges having the disadvantages of consuming disposables (the wooden stakes) and the reliance on the soil rigidity (around the stakes) for the retaining of the mold, and as is usually the case the soil has been freshly displaced (due to excavation and refill) meaning that the soil can be too soft (non rigid) for later mold retention, thus requiring additional stakes to be used, which costs additional time and increases the consumables. This issue is significant as the force placed upon the mold from the freshly poured concrete can be very high depending upon the shape of the mold, further adding stress upon the mold shape retainer system and in addition if the mold should warp, distort, deflect, or even worse if the mold should rupture from the poured concrete force it is difficult to fix and as the concrete will cure in the distorted shape which will typically be unacceptable, necessitating a complete removal of the distorted concrete and replacement of the concrete structure. Thus is further made worse as the mold is typically in a planar shape which has weak resistance to bending or distortion as against its flat surface which is where the force exists from the freshly poured concrete.

Thus the need for retaining apparatus for concrete molds is well recognized in the prior art and also the desire for a quick and easy engaging/disengaging of the retaining apparatus as this engaging and disengaging process is done in a repeated manner many times. Starting with U.S. Pat. No. 5,234,654 to Brooks disclosed is a concrete forming system design primarily for flatwork, i.e. sidewalks that includes a beam that spans transversely across the side edge mold portions to retain the mold side edge portions at a desired distance, wherein the beam is positioned flat on the bottom or underneath the poured slab, i.e. with the beam being positioned external to the slab. While Brooks is functionally adequate it is overly complex in requiring fabricated pieces with multiple set holes taking more assembly/disassembly time that does not allow for an infinite range of spacing adjustment between the mold portions and the typical consumption of the beam being left under the concrete. Brooks, however, does have the advantage of having the beam and its form attachments underneath the slab, thus providing for unimpeded top slab surface finishing from the retaining apparatus. Further, in U.S. Pat. No. 6,234,447 B1 to Boyden et al., disclosed is a spacer for concrete form walls that is primarily design to "space apart" the form wall sections to help overcome the tendency of the upper portion of the form walls from angling inward from the force of the freshly poured concrete as against the form wall surface. Boyden et al., accomplishes this using a threaded spacer rod with movable end plates secured by nuts threadably engaged to the rod, while this arrangement allows for an infinite form spacing adjustment, it is more costly to make and has the potential for the threads to corrode and entrap small pieces of concrete which would greatly interfere with the smooth operation of the threadable engagement.

Continuing in this same area of the prior art in United States Patent Application Publication Number 2007/0069104 A1 to Morin disclosed is a concrete forming structure frame locking device that attaches to a form, facilitating adjustment between form portions by the use of telescoping nested channel pieces that are axially locked to one another by a threaded clamp that pinches together the channel pieces locking them in a selected telescopic extension. While somewhat similar to Boyden et al., with Morin allowing an infinite number of axial distance locking settings within the axial distance range of the telescoping channels, there are still the issues of corrosion and concrete interfering with the operation of the threads. Next, in looking at concrete form retainers that are disposed within the form interior i.e. being embedded within the concrete, in U.S. Pat. No. 6,918,567 B2 to Ward et al., disclosed is a concrete panel with gripping ribs and a provision for a sheathed tensioner cable between panels. Ward et al., is an example of having the double use of the cable being a form retainer and after the poured concrete has cured tensioning the cable to provide permanent rigidity to the concrete structure, with the drawback being the complexity, time and cost of the sheathed tensioning cable arrangement with the concrete form. Yet further, in another arrangement for reinforcing forms in U.S. Pat. No. 4,635,895 to Johnson, Jr. et al., disclosed is a concrete form spreader bracket that is used in conjunction with a braced stake, however, having the drawback of limited size adjustment of the bracket between the forms as the bracket is setup for basically a fixed configuration of form width and height in addition to not being particularly quick and easy to assemble or disassemble.

Continuing, in looking at the applicable prior art for form retainers, in U.S. Pat. No. 5,343,667 to Peden disclosed is a form brace that uses outrigger type support retainers with an over the top clamp for the concrete form panels, however being limited in form spacing variance that can be facilitated due to the length of the outriggers and the bracket size, thus flexibility of Peden in accommodating different form heights and widths is restrained. Similarly, in U.S. Pat. No. 7,076,925 B2 to Gagliano an integrated fitting is disclosed that is really designed to form a part of the cured concrete structure by anchoring the concrete structure into the earth in a cross rig type fashion somewhat like Peden, however, with the outriggers crossing one another for minimal space consumption outside of the form.

Yet further, in U.S. Pat. No. 4,066,237 to Bentz disclosed is a adjustable form stake assembly for holding a concrete form at a prescribed grade being a combination stake and spanning beam form holder, although in looking at the beam lying over the top edges of the form, finishing the top surface of the concrete would be difficult. However, again as in both Boyden et al. and Morin, Bentz has the undesirable feature of threaded connectors and/or retainers, that while allowing for infinite distance settings within a specified range for the form distance apart, however, the threads are not really practical in concrete work for the aforementioned reasons the threads becoming clogged with concrete and impairing their function. In a like design in U.S. Pat. No. 6,173,937 B1 to Cottongim disclosed is a cap clip and spreader for poured concrete wall forms, wherein the spreader acts to secure the wall forms, however, allowing a finishing trowel to pass underneath the spreader, however, having the drawback of requiring a special interface positioned on the top of the form for the spreader to attach to.

In a more traditional form of prior art for the retaining of concrete forms to one another looking at U.S. Pat. No. 4,247,073 to Vario disclosed is a concrete form tie assembly that is typically embedded in the poured concrete, the tie includes a rod with capped ends that are able to pre stress the rod axially with a wedge outside of the form and also has cone shaped sections that circumvent the rod on the inside edges of the form that push against a plate that substantially seals the opening in the form for the rod. The drawbacks of Vario include consumption of the tie in addition to having to penetrate the form and have extra hardware to secure, position, and seal the tie within the form. Similarly, in U.S. Pat. No. 7,144,530 B2 to Ward et al., disclosed is a concrete forming structure using threaded coupling slots that are engaged to a lattice framework that allows the threaded tie to be located almost anywhere along the form surface, however, again having the attendant disadvantages of a threaded interface as in the previously described Boyden et al., Morin, and Bentz.

What is needed is a simplified retaining apparatus having quick and easy assembly and disassembly, having an infinite range of adjustment within an allowable distance, requiring a minimum number of tools, having little or none consumable disposables, and not requiring a connection, penetration, or attachment therethrough any portion of the mold or form that would cause complication in so far as the interface with the poured concrete by causing an opening to seal or an additional removal step of the retaining apparatus from being partially disposed within the cured concrete structure.

SUMMARY OF INVENTION

The present invention is a retainer apparatus for retaining a form mold in a selected position that includes a beam having a longitudinal axis and a retaining member slidably engaged to the beam allowing for free movement along the longitudinal axis when the retaining member is in a free state. The retaining member has a lengthwise axis substantially perpendicular to the longitudinal axis in the free state, the retaining member also including a leg substantially parallel to the lengthwise axis, the leg extending from the slidable engagement and terminating in a form mold interface portion. The retaining member also including a head portion extending from the slidable engagement being substantially oppositely disposed from the leg.

Wherein operationally the retaining member is placed into a locked state by applying a force directionally toward the form mold interface portion that is positioned adjacent to the form mold. The force is applied upon the leg substantially parallel to the longitudinal axis causing the retaining member to pivot about the form mold interface portion resulting in the lengthwise axis and the longitudinal axis forming an acute angle to one another that changes the slidable engagement into a substantially locked engagement at a selected location on the beam along the longitudinal axis resulting in the retaining member 74 being in a locked state. Further, operationally the retaining member is placed back into the free state from the locked state by applying a force to the head portion directionally away from the form mold interface portion wherein the force is also substantially parallel to the longitudinal axis thus changing the acute angle to the substantially perpendicular relationship as between the longitudinal axis and the lengthwise axis.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
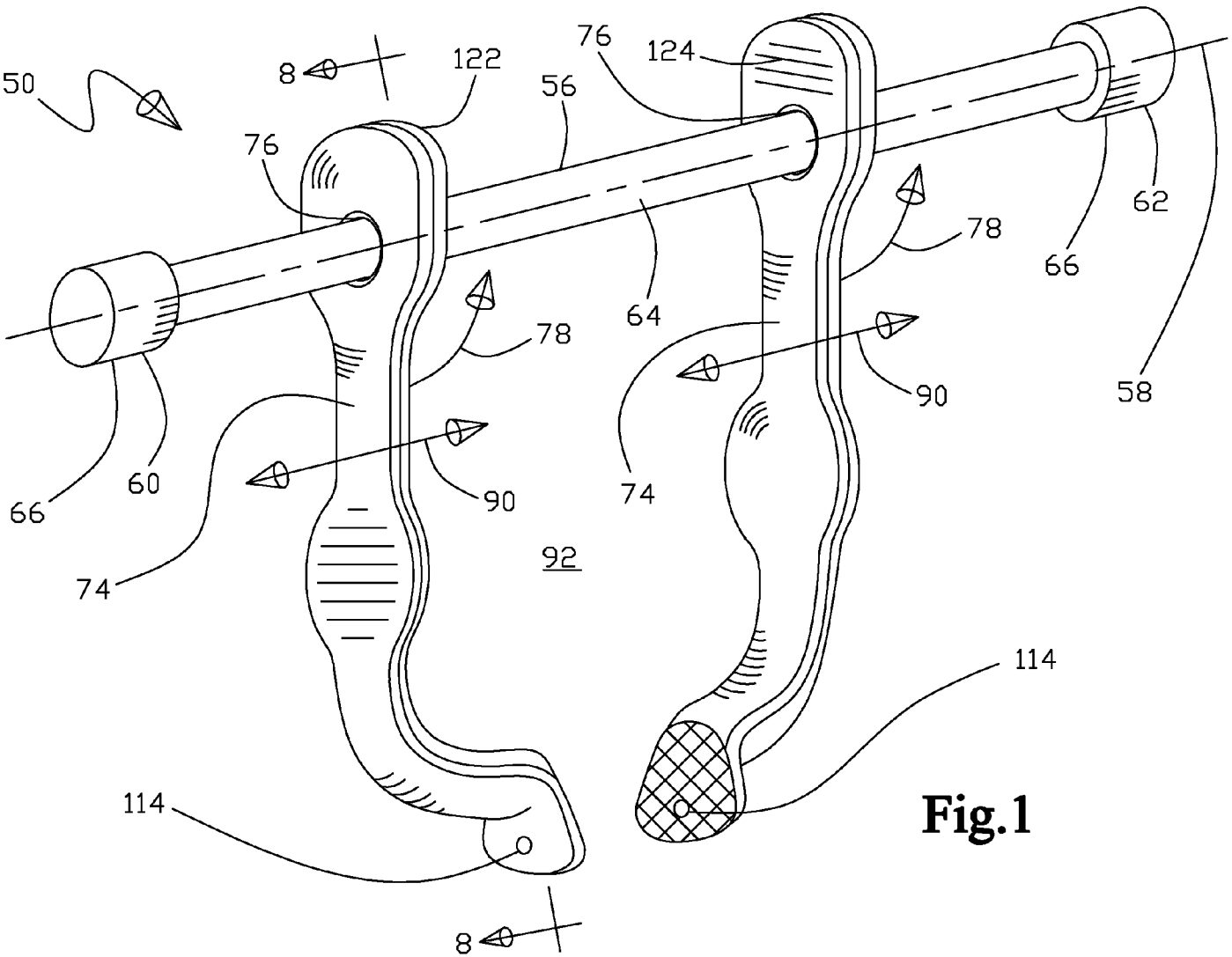
FIG. 1 is a perspective view of the retainer apparatus in the free state.

50 Retainer apparatus
52 Form mold
54 Selected position of form mold 52
56 Beam
58 Longitudinal axis of the beam 56
60 First end portion of beam 56
62 Second end portion of beam 56
64 Span portion of beam 56 between the first end portion 60 of the beam 56 and the second end portion 62 of the beam 56
66 Means for substantially retaining the retaining member 74 in the slidable engagement 76 of the beam 56 span 64
68 Surface
69 Earth
70 First end portion 60 of the beam 56 that is sized and configured to penetrate the surface 68
72 First end portion 60 of the beam 56 that is operable as a driving stake
74 Retaining member
76 Slidable engagement of the retaining member 74
78 Rotational movement of the retaining member 74 about the longitudinal axis 58
80 Interface clearance of the slidable engagement 76
82 Plane of measurement for the interface clearance 80 for the slidable engagement 76 that is substantially perpendicular to the longitudinal axis 58
84 Beam 56 dimension used for interface clearance 80 of the slidable engagement 76
86 Radius of retaining member 74 at the slidable engagement 76
88 Convex surface of the radius 86 of retaining member 74 at the slidable engagement 76
90 Free movement of retaining member 74 along the beam 56 longitudinal axis 58 in the free state 92
92 Free state of the retaining member 74
94 Lengthwise axis of the retaining member 74
96 Substantially perpendicular relationship between the longitudinal axis 58 and the lengthwise axis 94 and the plane 82
98 Hammer head
100 Leg of retaining member 74
102 Leg of the retaining member 74 that is sized and configured to have a portion to be adaptable for being manually struck by a hammer head 98
104 Substantially parallel relationship of leg 102 to lengthwise axis 94
106 Form mold interface portion of the retaining member 74
108 Mating surface portion of the form mold interface portion 106
110 Plane of the mating surface portion 108
112 Plane of mating surface portion 108 being substantially perpendicular to the longitudinal axis 58
114 Aperture therethrough of the mating surface portion 108
116 Aperture axis of the aperture 114 therethrough of the mating surface portion 108
118 Substantially parallel relationship of aperture axis 116 to the longitudinal axis 58
119 Axial length of slidable engagement 76 of the retaining member 74
120 Fastener for the aperture therethrough 114
122 Head portion of the retaining member 74
124 Head portion of the retaining member 74 sized and configured to be manually struck by a hammer head 98
126 Locked state of retaining member 74
128 Force application as against the leg 100
130 Substantially parallel application of force 128 or 140 to the longitudinal axis 58
132 Pivot movement about the form mold interface 106
134 Acute angle between the longitudinal axis 58 and the lengthwise axis 94
136 Substantially locked engagement of the slidable engagement 76
138 Selected location on the beam 56 along the longitudinal axis 58
140 Force application as against the head portion 122
142 Positioning the retainer apparatus 50 such that the pair of form mold interface portions 106 are each adjacent to a selected location 144 on the form mold 52
144 Adjacent selected location of the form mold interface portions 106 on the form mold 52
146 First movement of form mold
148 Second movement of form mold

DETAILED DESCRIPTION

Figure 2:
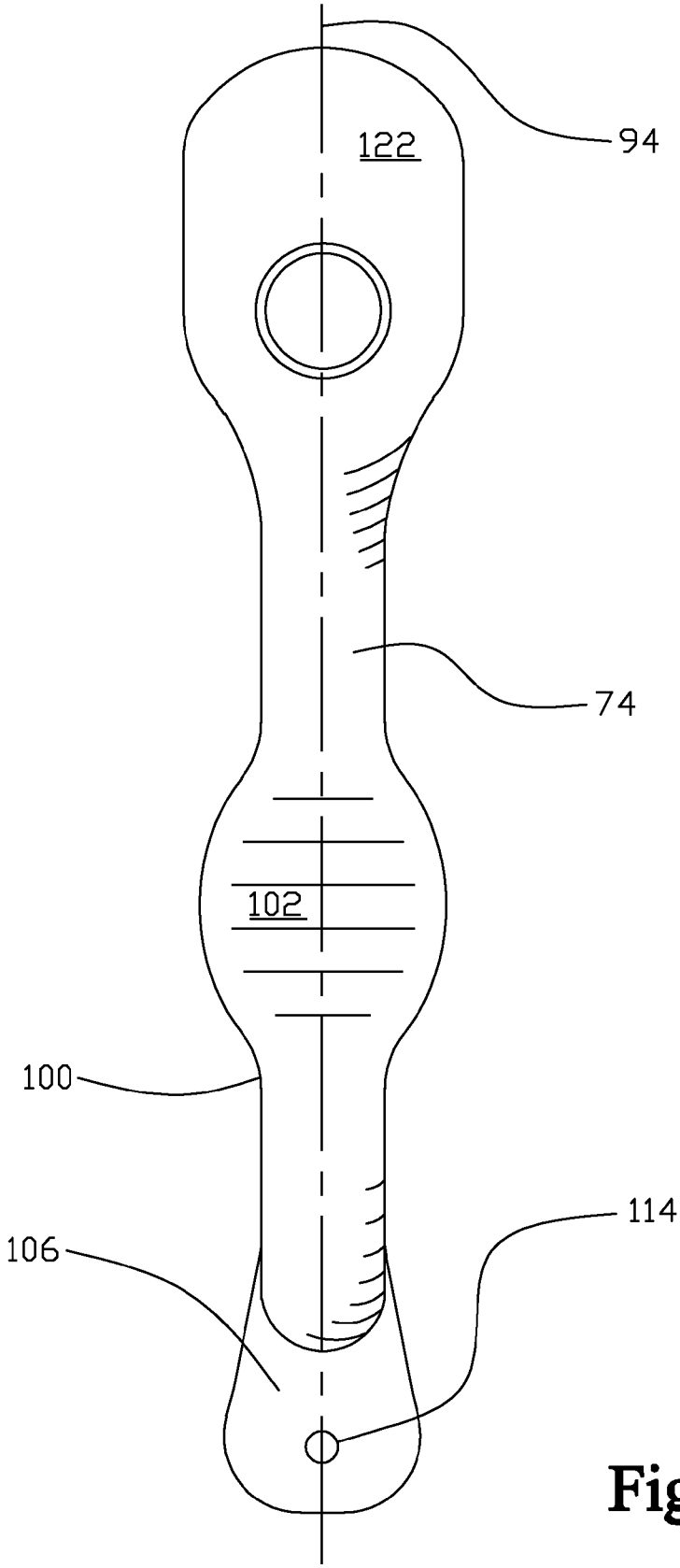
FIG. 2 is an end view of the retaining member opposing the form mold interface, also showing the leg of the retaining member sized and configured to be manually struck by a hammer head.
Figure 3:
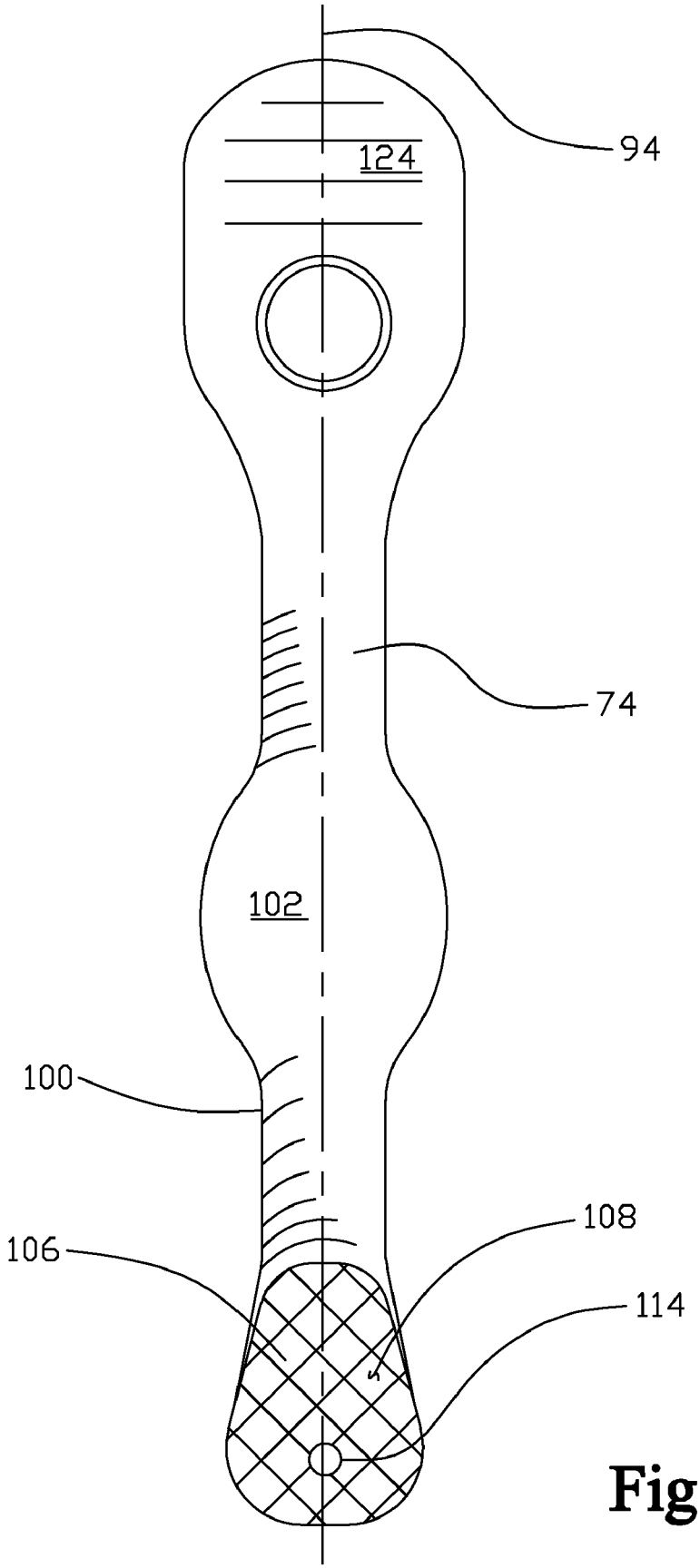
FIG. 3 is an end view of the retaining member on the form mold interface side, also showing the leg of the retaining member and the head of the retaining member that is also sized and configured to be manually struck by a hammer head.
Figure 4:
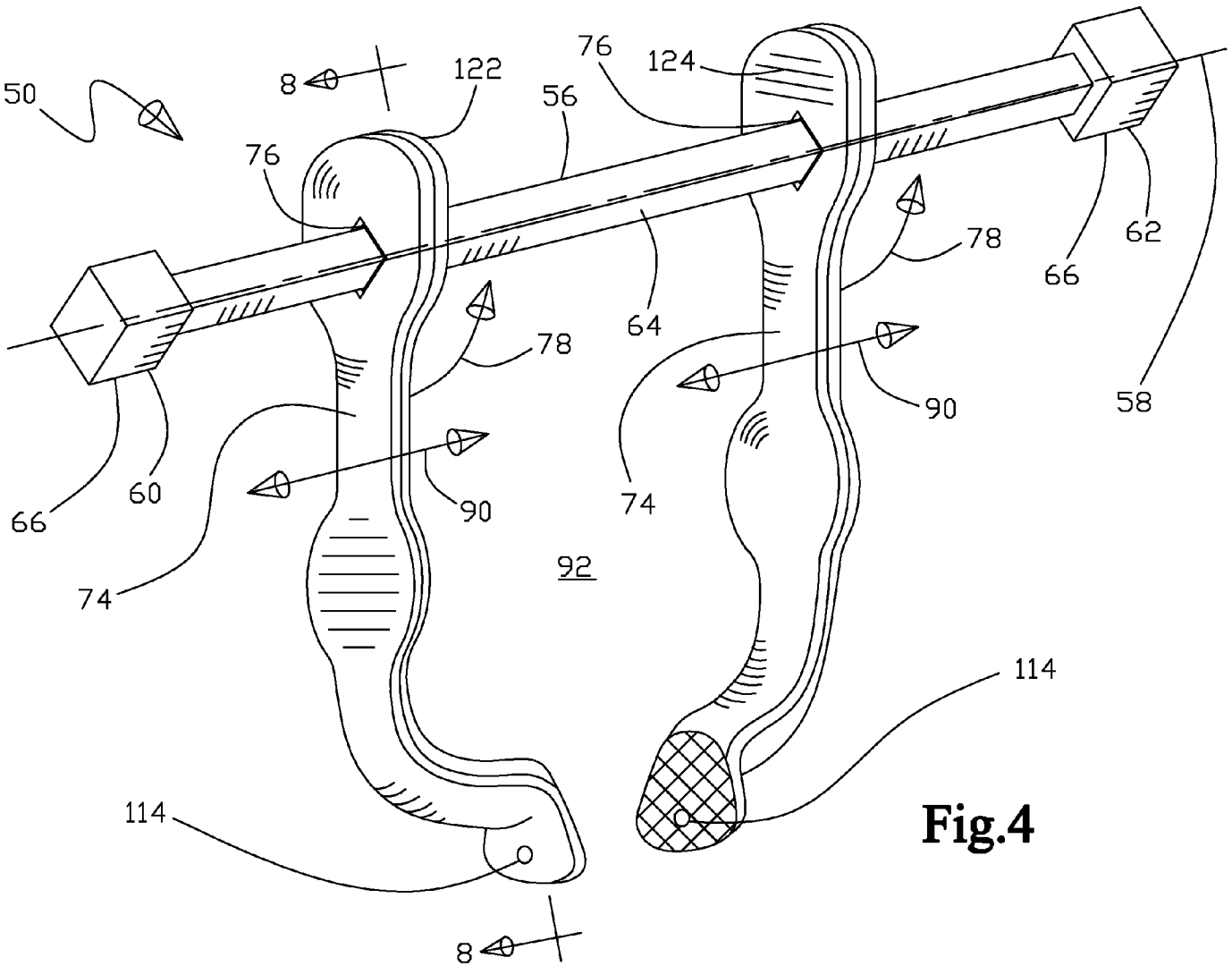
FIG. 4 is a perspective view of an alternative embodiment of the retainer apparatus that restricts rotational movement of the retaining member about the longitudinal axis that is also in the free state.

With initial reference to 1 is a perspective view of the retainer apparatus 50 in the free state 92 specifically referring to the retaining member 74, and FIG. 2 is an end view of the retaining member 74 opposing the form mold interface 106 surface 108, also showing the leg 100 of the retaining member 74 sized and configured 102 to be manually struck by a hammer head 98. Continuing, FIG. 3 is an end view of the retaining member 74 on the form mold interface 106 side, also showing the leg 100 of the retaining member 74 and the head 122 of the retaining member 74 that is also sized and configured 124 to be manually struck by a hammer head 98 and FIG. 4 is a perspective view of an alternative embodiment of the retainer apparatus 50 that restricts rotational movement 78 of the retaining member 74 about the longitudinal axis 58 that is also in the free state 92, resulting in a restriction of rotational movement 78 and allowing free movement 90.

Figure 5:
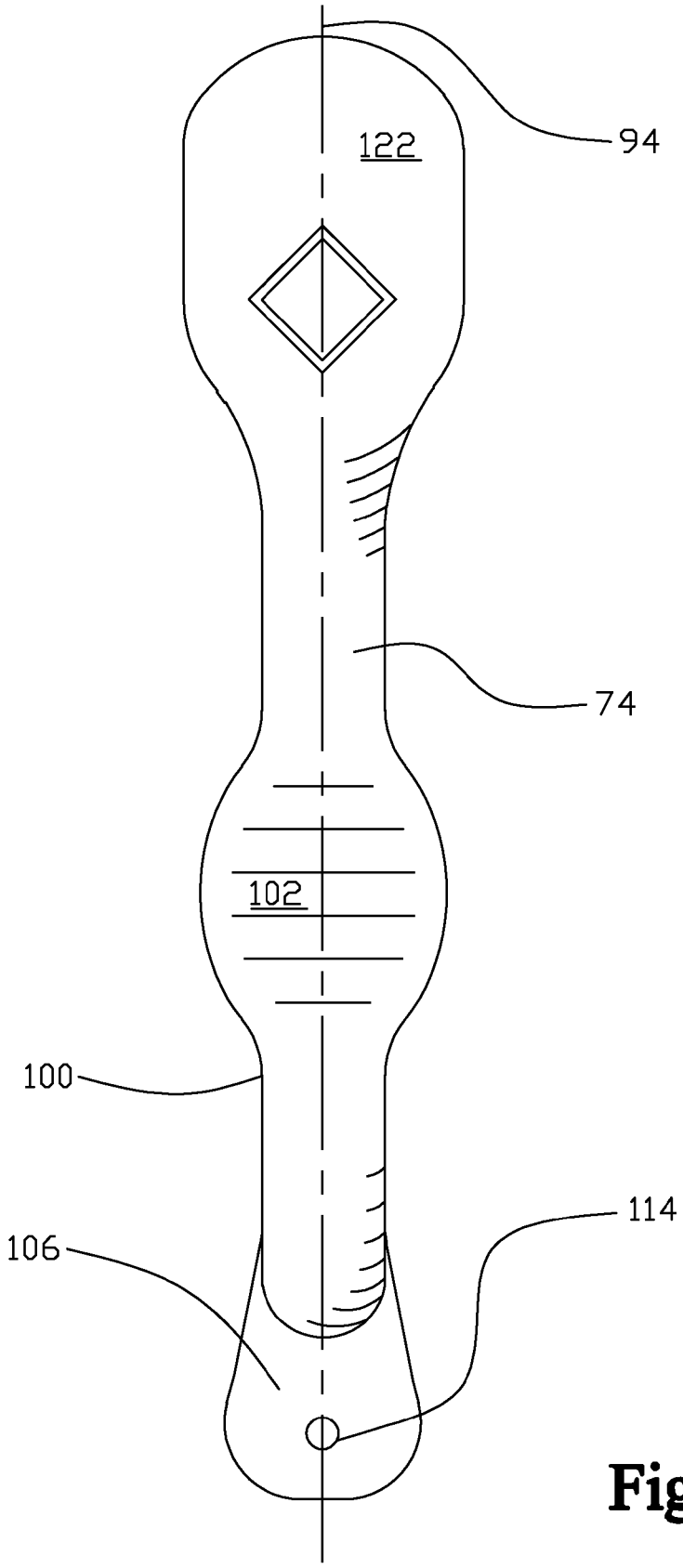
FIG. 5 is an end view of the alternative embodiment of the retaining member opposing the form mold interface, also showing the leg of the retaining member sized and configured to be manually struck by a hammer head.
Figure 6:
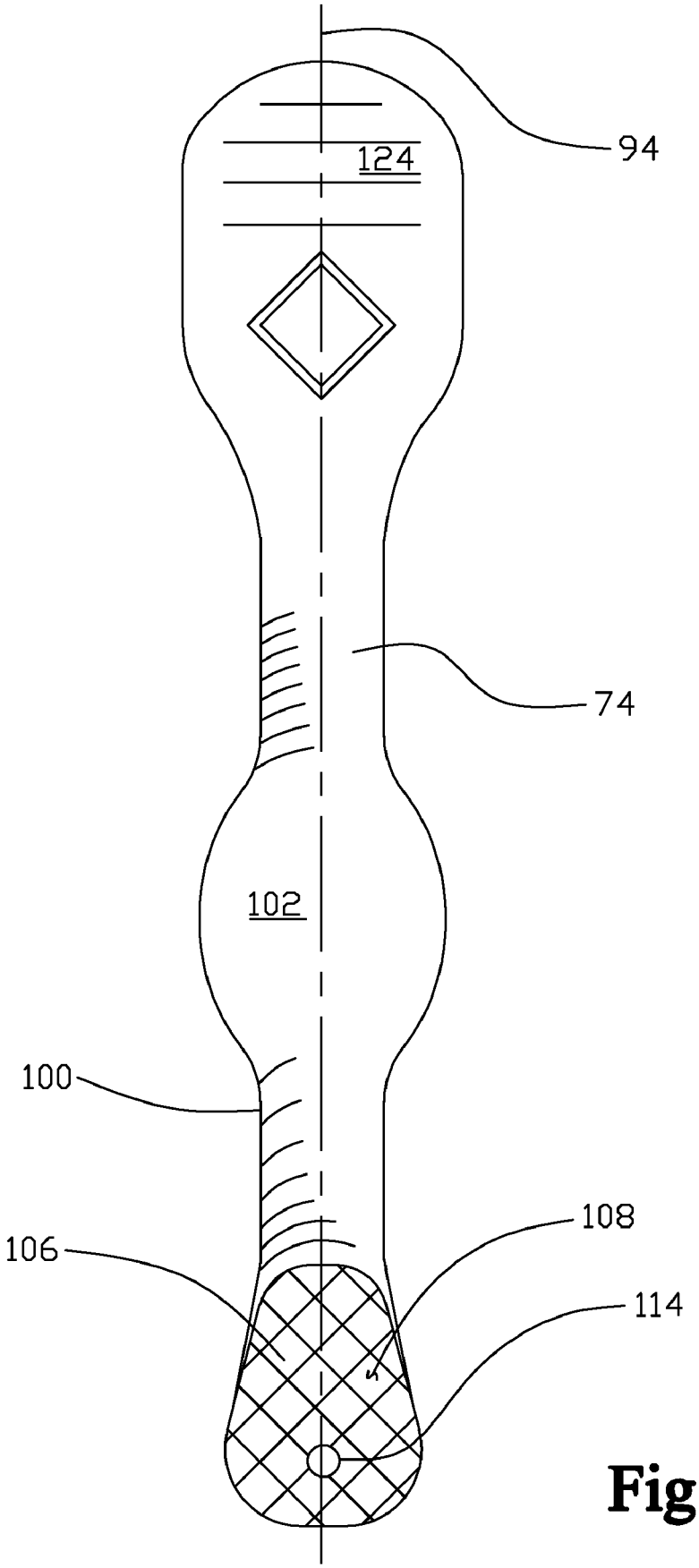
FIG. 6 is an end view of the alternative embodiment of the retaining member on the form mold interface side, also showing the leg of the retaining member and the head of the retaining member that is also sized and configured to be manually struck by a hammer head.
Figure 7:
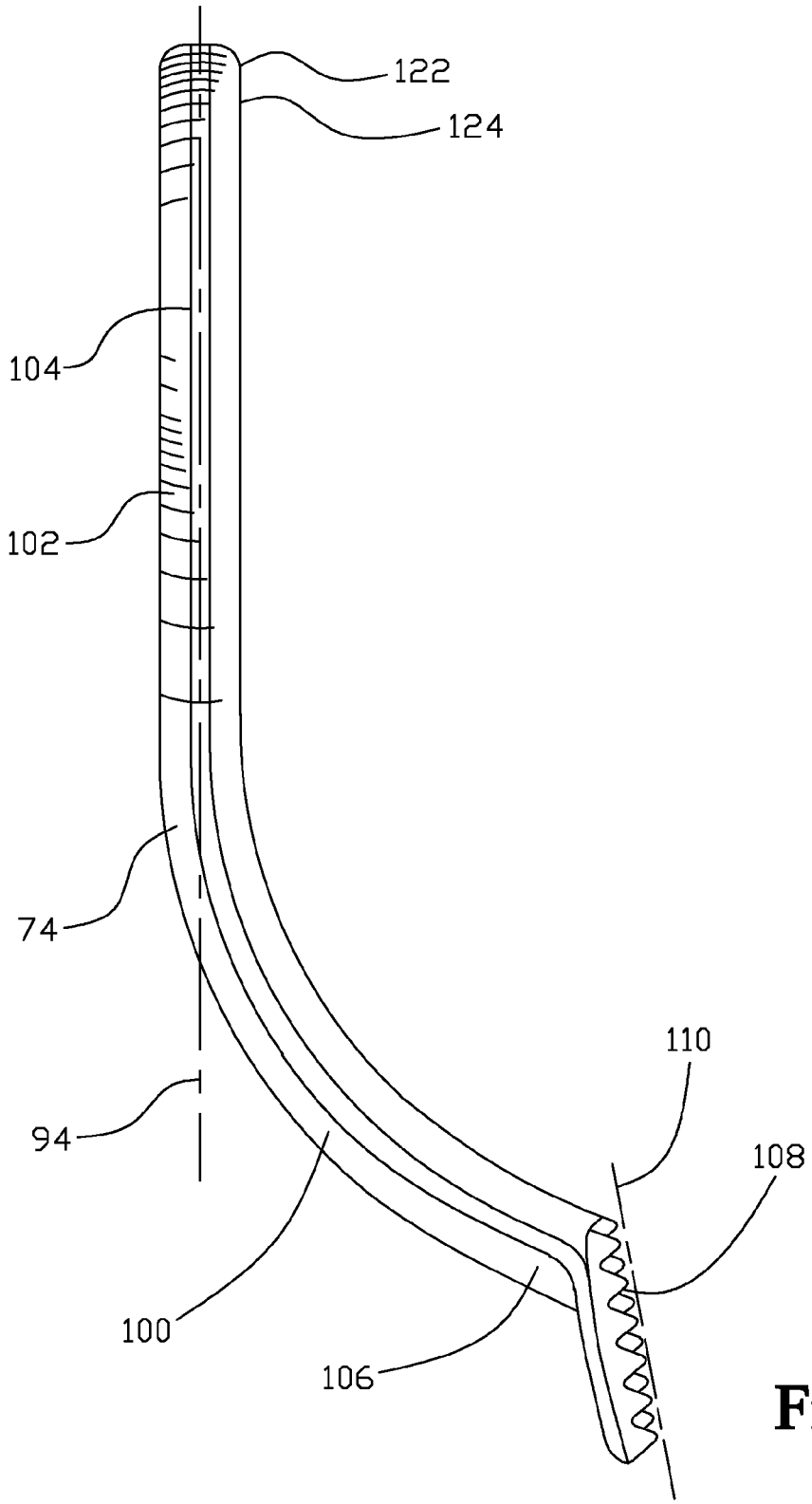
FIG. 7 is a side view of the retaining member.
Figure 8:
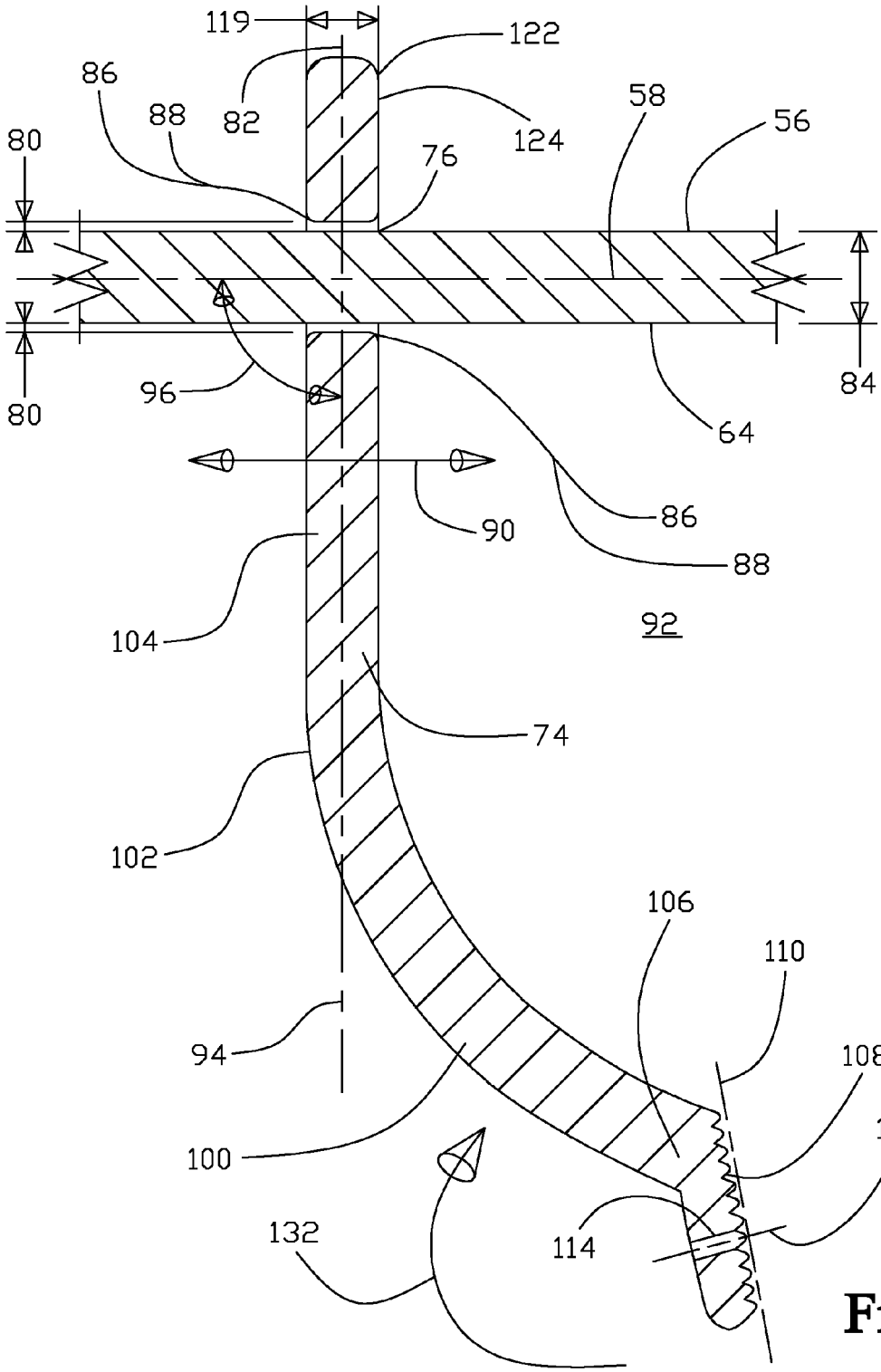
FIG. 8 is a cross sectional view of the beam and the retaining member in the free state, specifically showing the slidable engagement.
Figure 9:
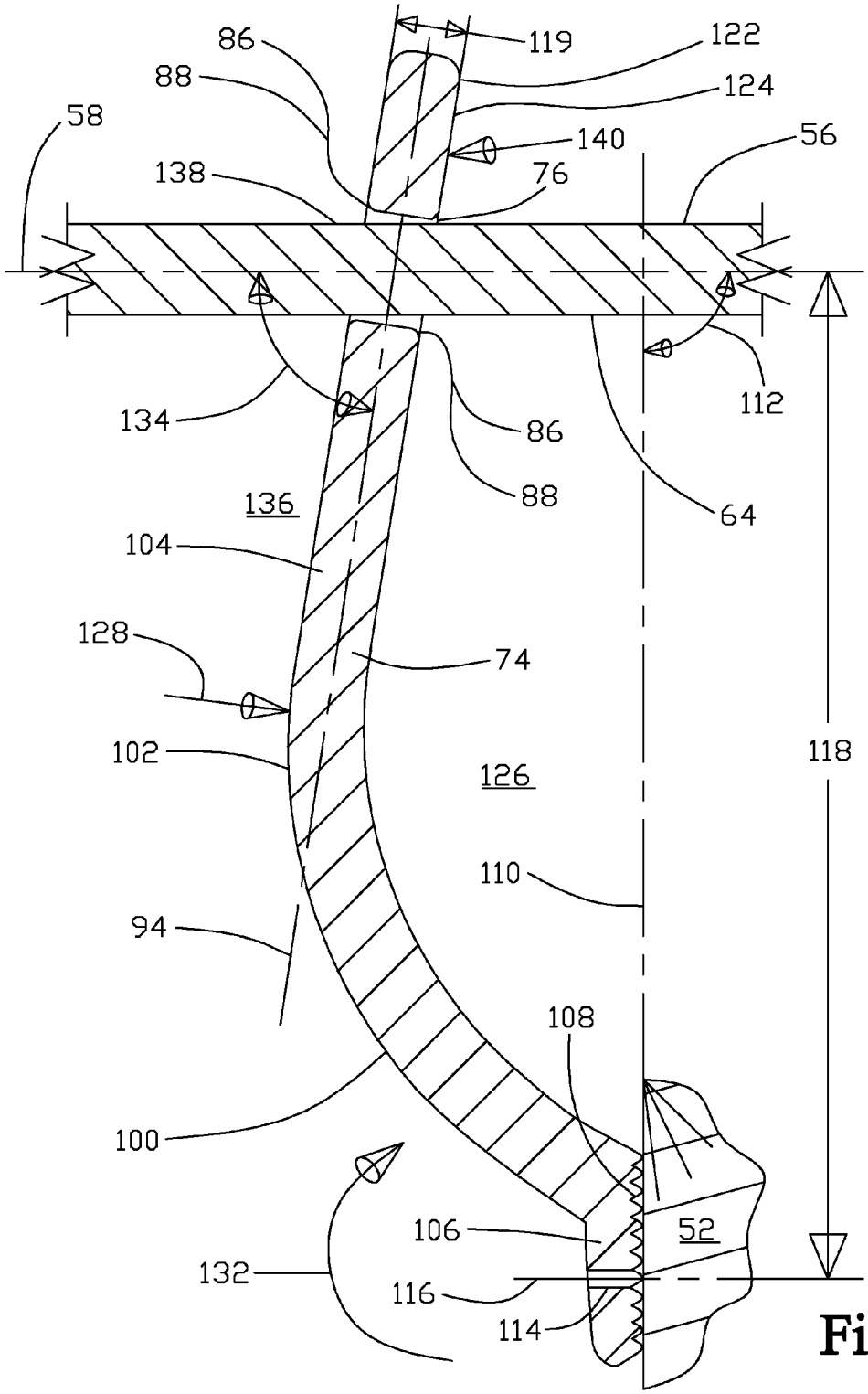
FIG. 9 is a cross sectional view of the beam and the retaining member in the locked state, specifically showing the slidable engagement.

Further, FIG. 5 is an end view of the alternative embodiment of the retaining member 74 opposing the form mold interface 106, also showing the leg 100 of the retaining member 74 sized and configured 102 to be manually struck by a hammer head 98 and FIG. 6 is an end view of the alternative embodiment of the retaining member 74 on the form mold interface 106 side, also showing the leg 100 of the retaining member 74 and the head 122 of the retaining member 74 that is also sized and configured 124 to be manually struck by a hammer head 98. Next, FIG. 7 is a side view of the retaining member 74, FIG. 8 is a cross sectional view of the beam 56 and the retaining member 74 in the free state 92, specifically showing the slidable engagement 76 that allows free movement 90 in the free state 92, and FIG. 9 is a cross sectional view of the beam 56 and the retaining member 74 in the locked state 126, specifically showing the slidable engagement 76 substantially restricting movement at the slidable engagement 76 along the longitudinal axis 58.

Figure 10:
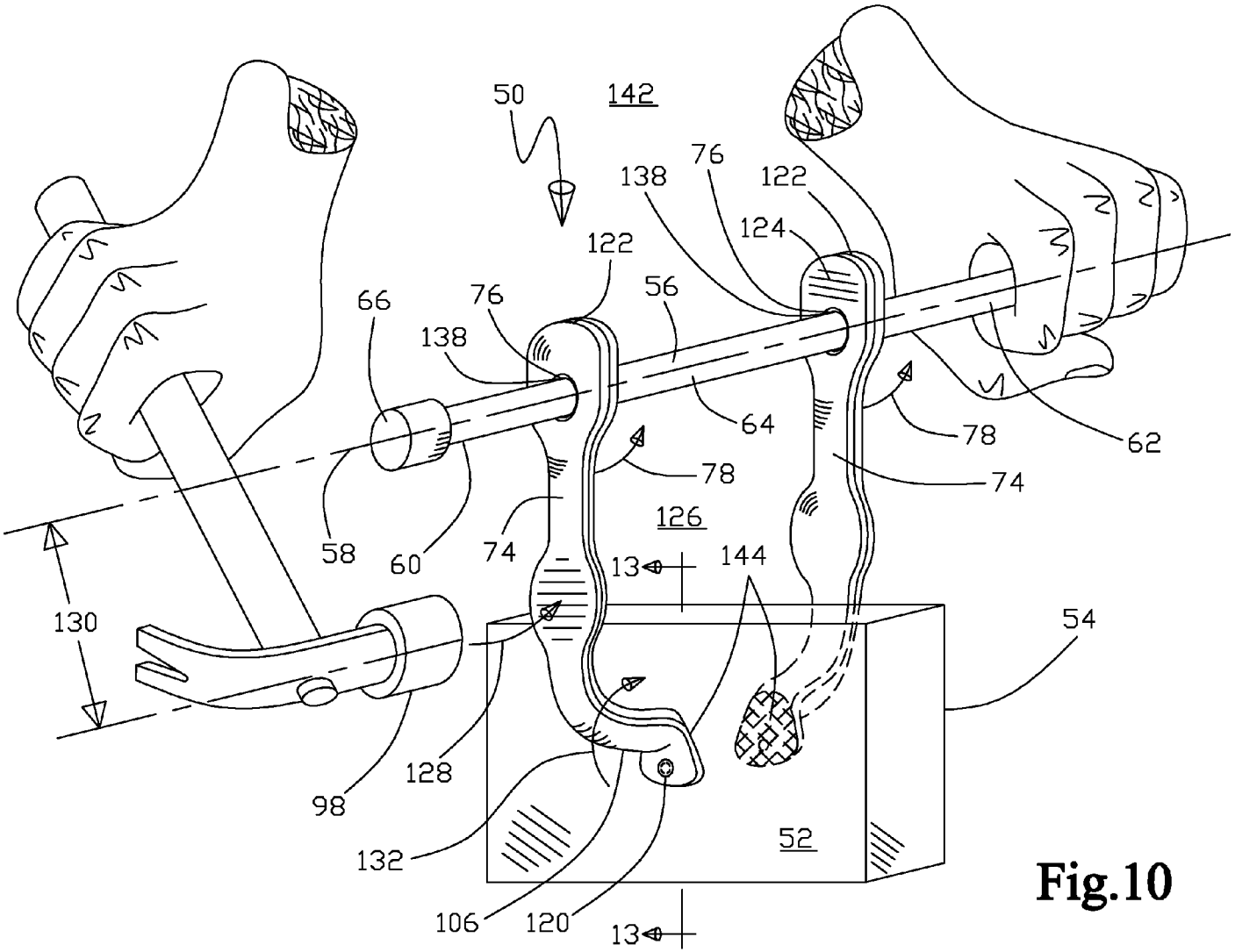
FIG. 10 shows a perspective view of the retainer apparatus in use being placed from the free state into the locked state at a selected location for the form mold interface portions to retain the form mold.
Figure 11:
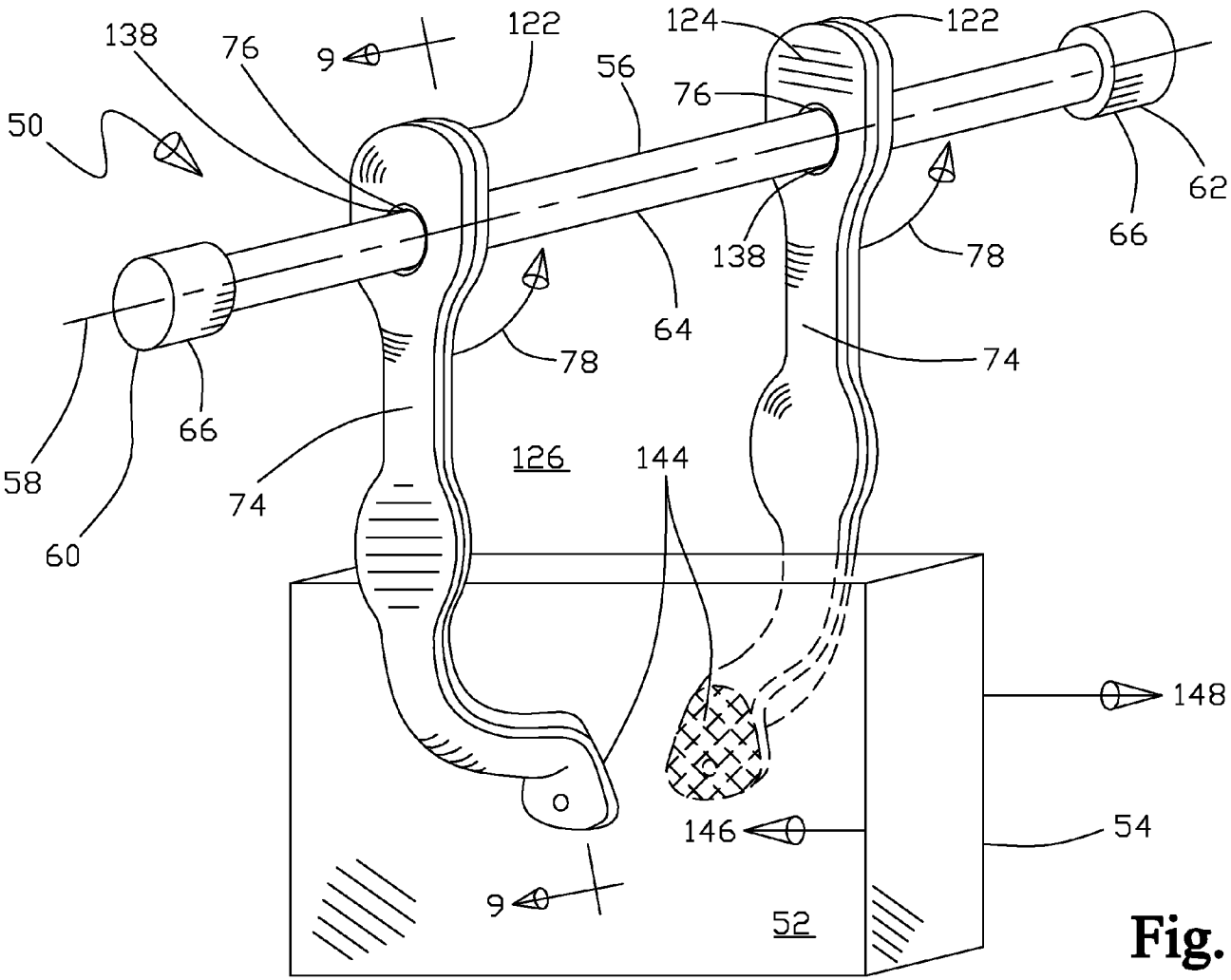
FIG. 11 shows a perspective view of the retainer apparatus in use being in the locked state retaining the form mold at a selected location.
Figure 12:
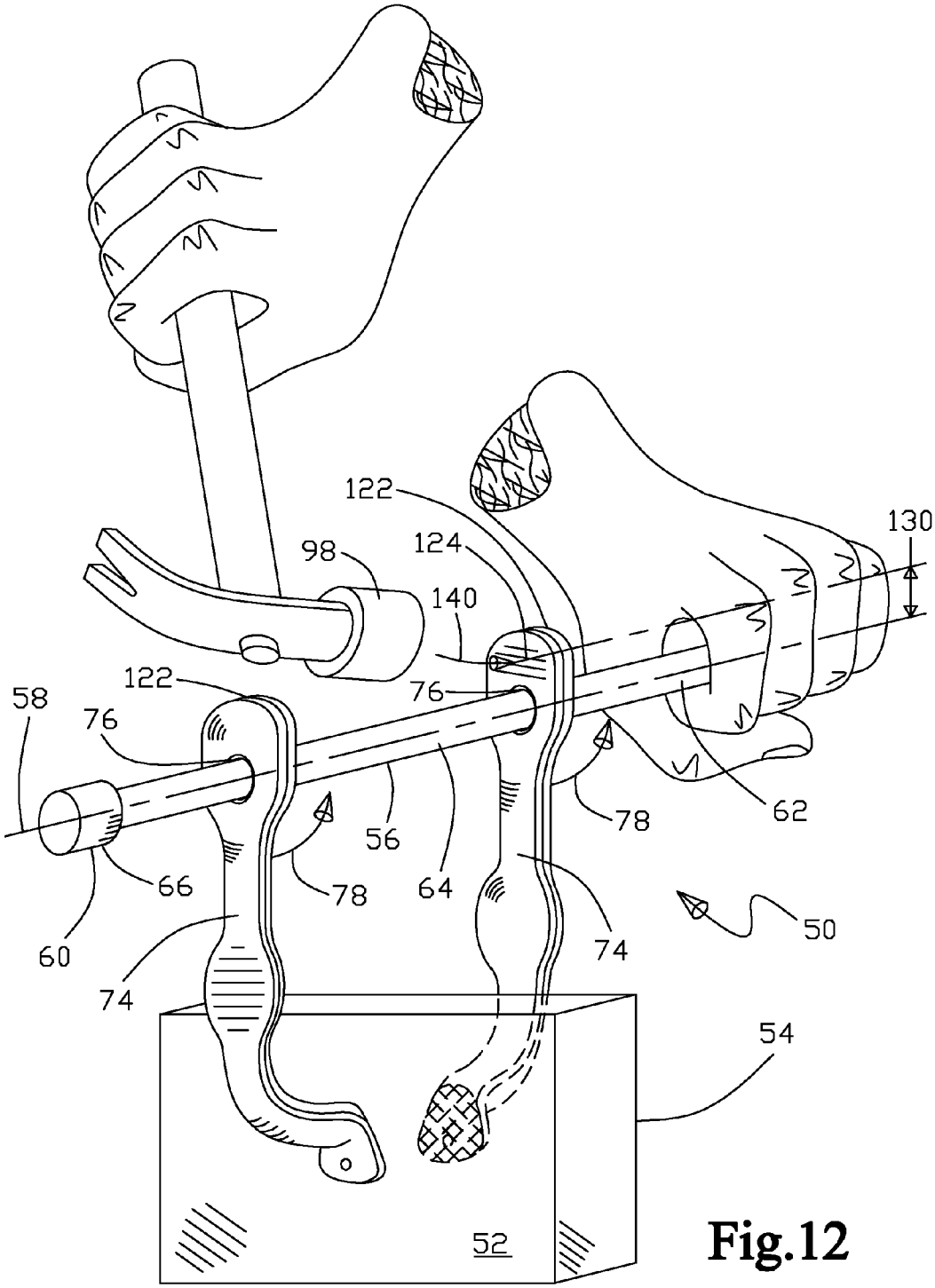
FIG. 12 shows a perspective view of the retainer apparatus in use being placed from the locked state into the free state to release the retainer apparatus from the form mold.
Figure 13:
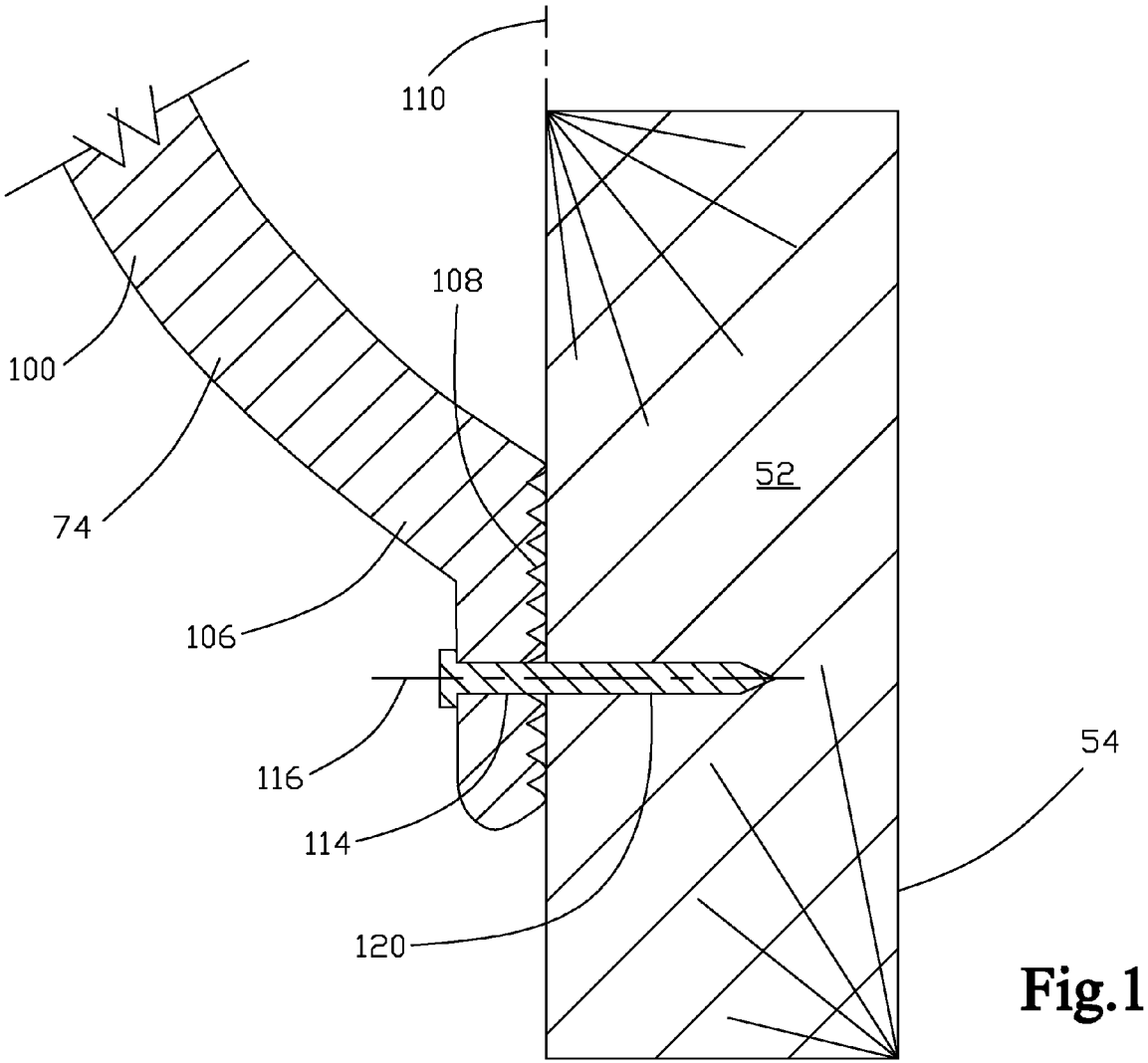
FIG. 13 is a cross sectional view of the retaining member, fastener, aperture, and form mold interface adjacent to the form mold, wherein the fastener attaches the form mold to the retaining member.

Yet further, FIG. 10 shows a perspective view of the retainer apparatus 50 in use being placed from the free state 92 into the locked state 126 at a selected location 144 for the form mold interface portions 106 to retain the form mold 52, FIG. 11 shows a perspective view of the retainer apparatus 50 in use being in the locked state 126 retaining the form mold 52 at a selected location to prevent movement 146 and 148, and FIG. 12 shows a perspective view of the retainer apparatus 50 in use being placed from the locked state 126 into the free state 92 to release the retainer apparatus 50 from the form mold 52. FIG. 13 is a cross sectional view of the retaining member 74, fastener 120, aperture 114, and form mold interface 106 adjacent to the form mold 52, wherein the fastener 120 attaches the form mold 52 to the retaining member 74 in either the free state 92 or the locked state 126.

Figure 14:
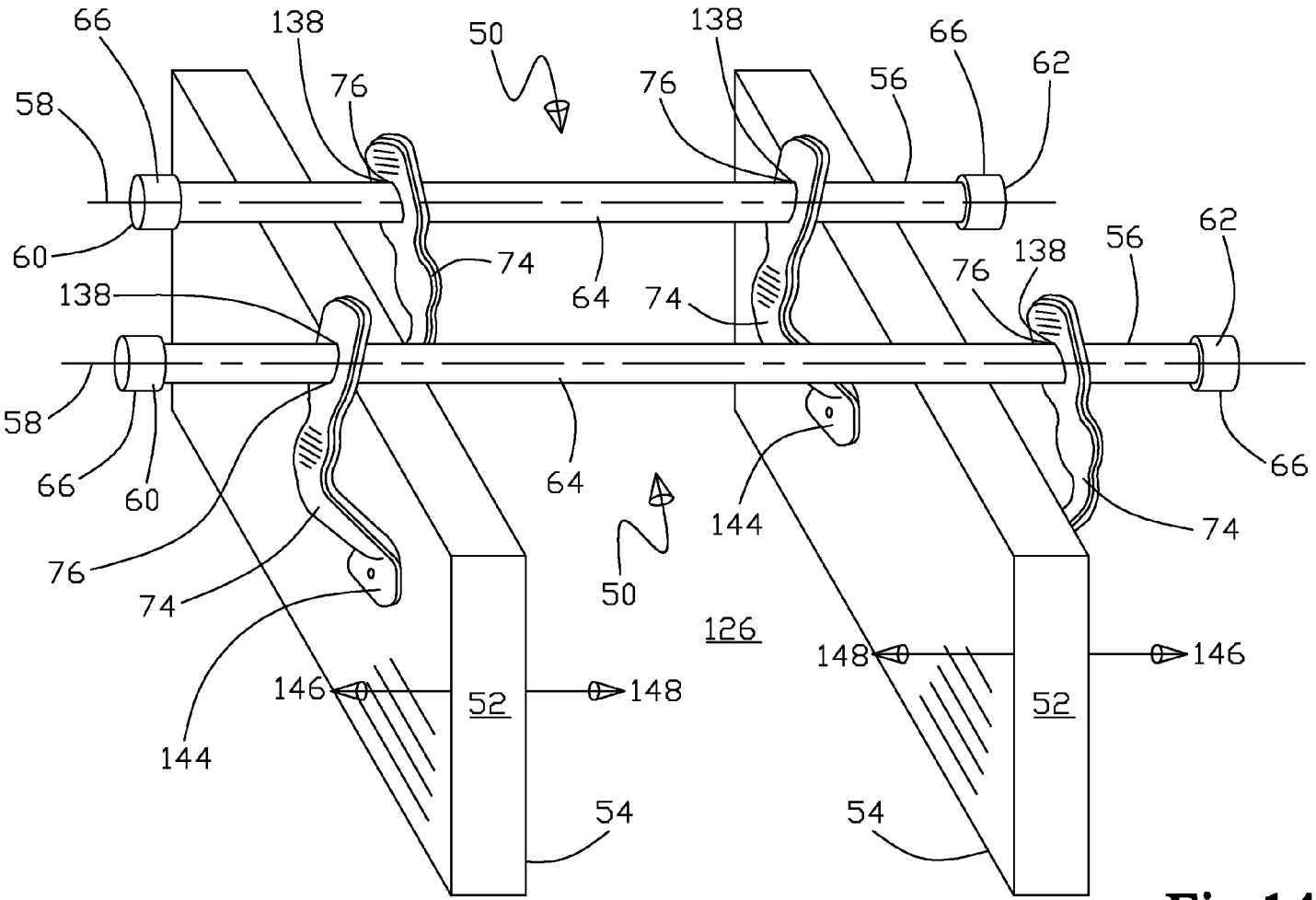
FIG. 14 is a perspective view of the use of a plurality of retainer apparatus in use to retain the form mold in multiple directions and as shown to retain the form mold substantially from a first outward movement and to retain the form mold substantially from a second inward movement.
Figure 15:
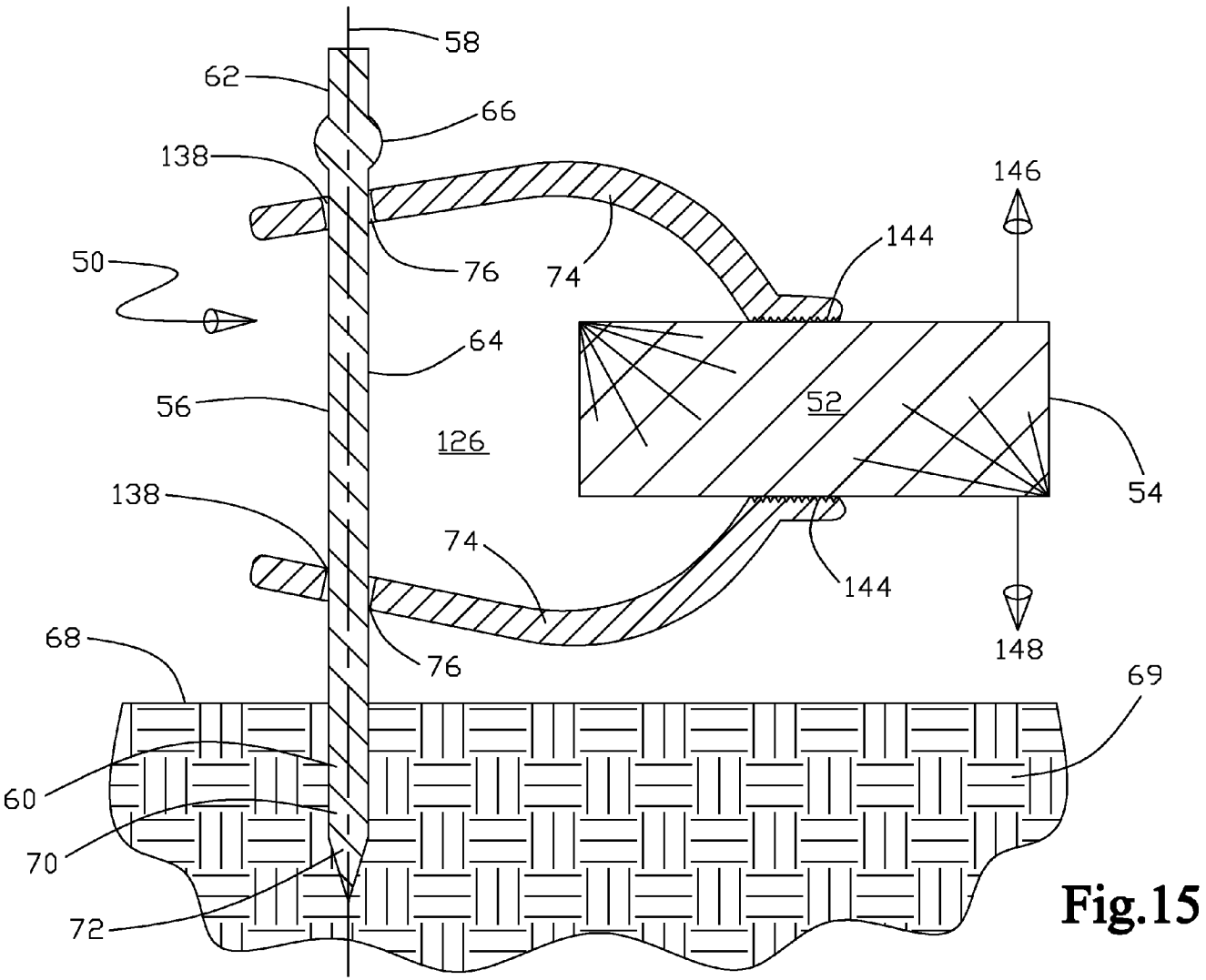
FIG. 15 shows a cross sectional view of the retainer apparatus in use with the first end portion of the beam sized and configured as a driving stake into the surface of the earth to retain the form mold substantially from a first movement and to retain the form mold substantially from a second movement.

Continuing, FIG. 14 is a perspective view of the use of a plurality of retainer apparatus 50 in use to retain the form mold 52 in multiple directions and as shown to retain the form mold 52 substantially from a first outward movement 146 and to retain the form mold substantially from a second inward movement 148 and FIG. 15 shows a cross sectional view of the retainer apparatus 50 in use with the first end portion 60 of the beam 56 sized and configured 70 as a driving stake 72 into the surface 68 of the earth 69 to retain the form mold 52 substantially from a first movement 146 and to retain the form mold 52 substantially from a second movement 148.

Broadly, in referring to FIG. 1, the present invention is for a retainer apparatus 50 that is designed for the purpose of retaining the form mold 52 in a selected position as against helping to prevent undesirable movement 146 and 148 of the form mold 52 as best shown in FIG. 11. The retainer apparatus 50 includes a beam 56 having a longitudinal axis 58 and a retaining member 74 slidably engaged 76 to the beam 56 allowing for free movement 90 along the longitudinal axis 58 when the retaining member 74 is in a free state 92, specifically referring to FIGS. 1 to 3 and in particular FIG. 8. Further, the retaining member 74 has a lengthwise axis 94 that is substantially perpendicular 96 to the longitudinal axis 58 in the free state 92, the retaining member 74 also including the leg 100 also that is substantially parallel 104 to the lengthwise axis 94, the leg 100 extending from the slidable engagement 76 and terminating in a form mold interface portion 106, also as best shown in FIGS. 1 to 3, and FIG. 8. Continuing, the retaining member 74 also including a head portion 122 extending from the slidable engagement 76 being substantially oppositely disposed from the leg 100 as best shown in FIGS. 1 to 3, 7 and 8.

Wherein, in referring specifically to FIGS. 9 and 10, operationally the retaining member 74 is placed into a locked state 126 by applying a force 128 directionally toward the form mold interface portion 106 that is positioned adjacent 144 to the form mold 52. The force 128 that is applied upon the leg 100 is substantially parallel 130 to the longitudinal axis 58 causing the retaining member 74 to pivot 132 about the form mold 52 interface portion 106 resulting in the lengthwise axis 94 and the longitudinal axis 58 forming an acute angle 134 that changes the slidable engagement 76 into a substantially locked 136 engagement at a selected location 138 on the beam 56 along the longitudinal axis 58, looking specifically at FIG. 9. Further, in referring in particular to FIGS. 8 and 12, operationally the retaining member 74 is placed back into the free state 92 from the locked state 126 by applying a force 140 to the head portion 122 directionally away from the form mold interface portion 106 substantially parallel 130 to the longitudinal axis 58 thus changing the acute angle 134, as shown in FIG. 9 to the substantially perpendicular relationship 96 as between the longitudinal axis 58 and the lengthwise axis 94 as best shown in FIG. 8.

In looking at FIGS. 2, 3, 5, 6, 8, 9, and 12, optionally the retainer apparatus 50 can have the head portion 122 being sized and configured 124 to be manually struck 140 by a hammer head 98, such that the retaining member 74 is easily removed from the form mold 52 and thus the retainer apparatus 50 is easily removed from the form mold 52. Looking at FIGS. 8 and 9, applying a force 140 typically with the hammer 98 moves the retaining member 74 from the locked state 126 as shown in FIG. 9 to the free state 92 as shown in FIG. 8 wherein movement 90 is allowed. The aforementioned sizing and configuring 124 is preferably accomplished by having the head portion 122 sized to be equal to or greater than the hammer 98 head area and with the head portion 122 having a thickness and surface finish comparable to a driving wedge for splitting wood that is designed for many multiple impacts from the hammer 98 without significant damage.

In looking at FIGS. 2, 3, 5, 6, 8, 9, and 10, optionally the retainer apparatus 50 can have the leg 100 being sized and configured 102 to be manually struck 128 by a hammer head 98, such that the retaining member 74 is easily secured to the form mold 52 and thus the retainer apparatus 50 is operational to help prevent the movement 146 and 148 of the form mold 52 from its desired position or location. Looking at FIGS. 8 and 9, applying a force 128 typically with the hammer 98 moves the retaining member 74 from the free state 92 as shown in FIG. 8 to the locked state 126 as shown in FIG. 9 wherein movement 90 as shown in FIG. 8 is not allowed. The aforementioned sizing and configuring 102 is preferably accomplished by having the leg 100 sized to be equal to or greater than the hammer 98 head area and with the leg 100 having a thickness and surface finish comparable to a driving wedge for splitting wood that is designed for many multiple impacts from the hammer 98 without significant damage.

In addition, optionally the retainer apparatus 50 in specifically referring to FIGS. 2, 3, 5 to 11, and 13 to 15 the form mold interface portion 106 can further comprise a mating surface portion 108 that is positioned adjacent 144 to the form mold 52. Wherein the mating surface portion 108 is sized and configured to form a plane 110 that is substantially perpendicular 112 to the longitudinal axis 58 when the retaining member 74 is in the locked state 126 as best shown in FIG. 9. This substantially perpendicular 112 arrangement accommodates a solid surface 108 contact with the form mold 52 when the retaining member 74 is in the locked state 126 and has angle 134 that substantially locks the slidable engagement 76 and thus substantially fixes the free movement 90, as shown in FIG. 8, to retain the form mold 52 in a selected position as best shown in FIG. 9. Referring specifically to FIG. 9, angle 134 is preferably about eighty (80) degrees when the retaining member 74 is in the locked state 126, wherein the retaining member 74 cannot substantially have movement 90 that exists in the free state 92 as shown in FIG. 8.

Further, in particularly referring to FIGS. 1 to 6 and 8 to 13, the retainer apparatus 50 can alternatively include in the mating surface portion 108 an aperture 114 therethrough, wherein the aperture 114 therethrough includes an aperture axis 116 therethrough that is substantially parallel 118 to the longitudinal axis 58 when the retaining member 74 is in the locked state 126, as best shown in FIG. 9. In referring to FIG. 13, the aperture 114 is used with a fastener 120 to attach the form mold 52 to the retaining member 74 in either the free state 92, see FIG. 8, or the locked state 126, see FIG. 9. The fastener 120 can preferably be a common nail as is shown in FIG. 13, however, the fastener 120 can be a screw, bolt, rivet, or any other type of fastener 120 that can attach the form mold 52 to the retaining member 74 as defined above. Also, as indicated in FIGS. 11 and 14, a plurality of retaining members 74 could be used with each having the slidable engagement 76 with a single beam 56, and a plurality of retainer apparatus 50 could be used with a single form mold 52 for the purpose of securing the form mold 52 from movement 146 and 148.

Continuing, on the slidable engagement 76, and in referring specifically to FIGS. 4 to 6 and 8 to 9, the slidable engagement 76 between the beam 56 and the retaining member 74 forms an interface that is sized and configured to prevent rotational movement 78 of the retaining member 74 about the longitudinal axis 58 while at the same time maintaining the slidable engagement 76 when the retaining member 74 is in the free state 92 allowing movement 90, see FIG. 8 and maintaining the substantially locked state 126 of engagement of the retaining member 74 in the locked state 126 as shown in FIG. 9. The purpose of limiting rotational movement 78 is to allow for manual grasping of the beam 56 and while the beam is manually rotated in movement 78 about the longitudinal axis 58 the retaining member 74 will rotate in lockstep about the beam 56 longitudinal axis 58 with the beam 56 further allowing for one hand of the user to rotate 78 the beam 56 and being able to position the retaining member 74 form mold interface portion 106 to a selected location 144 on the form mold 52, further allowing the user's other hand to grasp the hammer 98 to secure and place the retaining member 74 in the locked state 126, see FIGS. 9 and 10. As is shown in FIGS. 4 to 6, the preferred structure for substantially limiting rotation 78 of the retaining member 74 about the longitudinal axis 58 is to have a "square" type interface at the slidable engagement 76, however, other configurations of slidable engagements 76 that accomplish the limitation of rotational movement 78 of the retaining member 74 about the longitudinal axis 58 relative to the beam 56 would be acceptable such as splines, keys, and the like.

Further, on the slidable engagement 76, in referring to FIGS. 8 and 9, of the retaining apparatus 50 the slidable engagement 76 is sized such that said retaining member 74 has an interface clearance 80 of about five (5) to ten (10) percent of the beam 56 dimension 84 as measured in a plane 82 substantially perpendicular 96 to the longitudinal axis 58. The clearance 80 allows for the retaining member 74 to pivot 132 about the form mold interface 106 and to change the substantially perpendicular 96 relationship between the longitudinal axis 58 and the lengthwise axis 94 to an acute angle 134 between the longitudinal axis 58 and the lengthwise axis 94, as shown in going from FIG. 8 to FIG. 9, respectively taking the retaining member 74 from the free state 92 to the locked state 126. This is turn restricts movement 90 as shown in FIG. 8, thus substantially securing the retaining member 74 to the beam 56 along the longitudinal axis 58, being accomplished by the application of a force 128 to the leg 100, causing the retaining member 74 to pivot 132 about the form mold interface 106 ultimately to substantially secure the form mold 52 in a selected or desired position, as shown in FIGS. 9 to 11. Further, to enhance the locked state 126 as described above and again referring to FIGS. 8 and 9, the retaining apparatus 50 retaining member 74 interface clearance 80 further comprises a radius 86 that is about five (5) to ten (10) times of the interface clearance 80, wherein the radius 86 forms a surface that is convex 88 in facing the beam 56. This convex 88 radius 86 surface is operational to increase the bearing area between the retaining member 74 and the beam 56 when the retaining member 74 is in the locked state 126 as shown in FIG. 9, thus effectively increasing the coefficient of friction between the retaining, member 74 and the beam 56 and enhancing the resistance to movement 90 of the retaining member 74 along the beam 56 longitudinal axis 58 when the retaining member 74 is in the locked state 126. The preferred materials of construction for the beam 56 and the retaining member 74 are malleable steel, however, other materials of construction would be acceptable such as composites that can meet the aforementioned functional requirements particularly relating to the free state 92 and the locked state 126.

As another further enhancement, to the beam 56, the retainer apparatus 50 can optionally have on the beam 56 a first end portion 60 and a second end portion 62 with a span portion 64 therebetween along the longitudinal axis 58, wherein the beam first end portion 60 and the beam second end portion 62 each further comprise a means 66 for substantially retaining the retaining member 74 in the slidable engagement 76 along the span portion 64, as best shown in FIGS. 1, 4, 10 to 12, 14, and 15. The purpose of the means 66 is to substantially prevent the retaining member 74 from sliding off of the beam 56 along the longitudinal axis 58 and thus helping to prevent the retaining member 74 from becoming separated from the beam 56. The means 66 is preferably either a swaged portion, being a protrusion in the beam 56 dimension 84, as best shown in FIGS. 8 and 15, or a pressed on cap as best shown in FIGS. 1, 4, 10 to 12, and 14. Other structure for accomplishing means 66 would include a threaded cap, welded cap, pinned cap, or any similar type of structure that is operational to help prevent the retaining member 74 from sliding off of the beam 56 along the bean longitudinal axis 58. Additionally, on the beam 56 of the retainer apparatus 50, in referring particularly to FIG. 15, the beam 56 first end portion 60 is optionally sized and configured 70 to penetrate a surface 68, wherein the beam 56 is operable as a driving stake 72 into the earth's 69 surface 68. This option allows the retainer apparatus 50 to retain the form mold 52 relative to the surface 68, which doesn't necessarily have to be earth 69, but could be a wall, ceiling, or any other structure that the beam 56 first end portion 60 that is sized and configured 70 to penetrate a surface 68. Note also in looking at FIG. 15, that any number of retaining members 74 could be used with a single beam 56 for retaining a form mold 52 is a selected or desired position to help prevent movement 146 and 148 of the form mold 52.

METHOD OF USE

Referring primarily to FIGS. 8, 9, and 10 to 15, disclosed is a method of use for the retainer apparatus 50. Thus, a method is given for retaining a form mold 52 in a selected position, comprising the steps of firstly providing a retainer apparatus 50 that includes a beam 56 having a longitudinal axis 58 and a pair of retaining members 74 that are each slidably engaged 76 to the beam 56 allowing for free movement 90 along the longitudinal axis 58 when the retaining members 74 are in a free state 92. Each of the retaining members 74 having a lengthwise axis 94 that is substantially perpendicular 96 to the longitudinal axis 58 in the free state 92, as shown in FIG. 8, also each of the retaining members 74 also include a leg 100 substantially parallel 104 to the lengthwise axis 94, with each leg 100 extending from the slidable engagement 76 and terminating in a form mold interface portion 106. In addition, each leg 100 is sized and configured 102 to have a portion adaptable to be manually struck by a hammer head 98, plus each retaining member also including a head portion 122 extending from the slidable engagement 76 being substantially oppositely disposed from the leg 100, with the head portion 122 being sized and configured 124 to be manually struck by a hammer head 98.

Continuing, a next step is in positioning 142 the retainer apparatus 50 such that the pair of form mold interface portions 106 are each adjacent 144 to a selected location on the form mold 52, as best shown in FIG. 10. The next further step, as best shown in going from FIG. 8 to FIG. 9 and further in FIG. 10, is in securing the retainer apparatus 50 into the locked state 126 by placing the retaining members 74 each into the locked state 126 by applying a hammer 98 force 128 directionally toward the form mold interface portion 106 that is positioned adjacent 144 to the form mold 52. The hammer 98 force 128 is applied upon each of the legs 100 substantially parallel 130 to the longitudinal axis 58 causing each of the retaining members 74 to pivot 132 about the form mold interface portion 106 resulting in the lengthwise axis 94 and the longitudinal axis 58 forming an acute angle 134 that changes the slidable engagement 76 into a substantially locked state 126 engagement at the selected location 138 on the beam 56 along the longitudinal axis 58, thus helping to prevent movement 90, as shown in FIG. 8. This results in the form mold 52 being retained in a selected position by the retainer apparatus 50 thus helping to prevent movement 146 and 148, as ultimately shown in FIG. 11.

As an option, the retainer apparatus 50 can further comprising a step of placing the retaining member 74 back into the free state 92 from the locked state 126, essentially going from FIG. 9 to FIG. 8 respectively, by applying a hammer 98 force 140 to the head 122 portion 124 directionally away from the form mold interface portion 106 substantially along the longitudinal axis 58 thus changing the acute angle 134 to the substantially perpendicular 96 relationship as between the longitudinal axis 58 and the lengthwise axis 94, resulting in the retaining member 74 having free movement 90 along the longitudinal axis 58 at the slidable engagement 76 interface, allowing the retainer apparatus 50 to be removed from the form mold 52.

CONCLUSION

Accordingly, the present invention of a retainer apparatus 50 has been described with some degree of particularity directed to the embodiments of the present invention. It should be appreciated, though, that the present invention is defined by the following claims construed in light of the prior art so modifications the changes may be made to the exemplary embodiments of the present invention without departing from the inventive concepts contained therein.

The invention claimed is:

1. A retainer apparatus for retaining a form mold in a selected position, comprising:

(a) a beam having a longitudinal axis wherein said beam is constructed of malleable steel;

(b) a hammer including a hammer head; and (c) a retaining member constructed of malleable steel, wherein said retaining member has a slidable engagement to said beam allowing for free movement along said longitudinal axis when said retaining member is in a free state, wherein said slidable engagement is sized such that said retaining member has an interface clearance of about five (5) to ten (10) percent of said beam as measured in a plane perpendicular to said longitudinal axis, wherein said retaining member interface clearance further comprises a radius that is about five (5) to ten (10) times of said interface clearance, wherein said radius forms a surface that is convex in facing said beam, said retaining member having a lengthwise axis substantially perpendicular to said longitudinal axis in said free state, said retaining member also including a leg substantially parallel to said lengthwise axis, said leg extending from said slidable engagement and terminating in a form mold interface portion, said form mold interface portion including a mating surface portion, said leg is sized and configured to have a portion adaptable to be manually struck by said hammer head, said portion adaptable to be manually struck by said hammer head includes a portion of said leg sized greater than said hammer head having a higher friction surface than an adjacent leg surface, said retaining member also including a head portion extending from said slidable engagement being substantially oppositely disposed from said leg, said head portion is sized and configured to be manually struck by said hammer head, said head portion sized and configured to be manually struck by said hammer head includes a portion of said leg sized greater than said hammer head having a higher friction surface than an adjacent leg surface, wherein operationally said retaining member is placed into a locked state by applying a hammer force from said hammer head to said portion adaptable to be manually struck by said hammer head directionally toward said form mold interface portion mating surface that is positioned adjacent to the form mold, said hammer force is applied upon said leg substantially parallel to said longitudinal axis causing said retaining member to pivot about said form mold interface portion resulting in said lengthwise axis and said longitudinal axis forming an acute angle of about eighty (80) degrees and wherein said mating surface portion is positioned to be perpendicular to said beam longitudinal axis when said slidable engagement is transformed into a substantially locked engagement at a selected location on said beam along said longitudinal axis, further operationally said retaining member is placed back into said free state from said locked state by applying a hammer force from said hammer head to said head portion directionally away from said form mold interface portion substantially parallel to said longitudinal axis thus changing said acute angle to said substantially perpendicular relationship as between said longitudinal axis and said lengthwise axis.

2. A retainer apparatus according to claim 1 wherein said mold form interface portion further comprises an aperture therethrough, wherein said aperture therethrough includes an aperture axis therethrough that is substantially parallel to said longitudinal axis when said retaining member is in said locked state, wherein operationally said aperture is used with a fastener to attach the form mold to said retaining member in either said free state or in said locked state.

3. A retainer apparatus according to claim 1 wherein said slidable engagement between said beam and said retaining member form an interface that is selected from the group consisting of square and round area cross sections as viewed perpendicular to said longitudinal axis.

4. A method for retaining a form mold in a selected position, comprising the steps of:

(a) providing a retainer apparatus that includes a beam, wherein said beam is constructed of malleable steel, said beam having a longitudinal axis, a hammer including a hammer head, and a pair of retaining members constructed of malleable steel, wherein said retaining member has a slidable engagement to said beam allowing for free movement along said longitudinal axis when said retaining member is in a free state, wherein said slidable engagement is sized such that said retaining member has an interface clearance of about five (5) to ten (10) percent of said beam as measured in a plane perpendicular to said longitudinal axis, wherein said retaining member interface clearance further comprises a radius that is about five (5) to ten (10) times of said interface clearance, wherein said radius forms a surface that is convex in facing said beam, said retaining member having a lengthwise axis substantially perpendicular to said longitudinal axis in said free state, said retaining member also including a leg substantially parallel to said lengthwise axis, said leg extending from said slidable engagement and terminating in a form mold interface portion, said form mold interface portion including a mating surface portion, said leg is sized and configured to have a portion adaptable to be manually struck by said hammer head, said portion adaptable to be manually struck by said hammer head includes a portion of said leg sized greater than said hammer head having a higher friction surface than an adjacent leg surface, said retaining member also including a head portion extending from said slidable engagement being substantially oppositely disposed from said leg, said head portion is sized and configured to be manually struck by said hammer head, said head portion sized and configured to be manually struck by said hammer head includes a portion of said leg sized greater than said hammer head having a higher friction surface than an adjacent leg surface, wherein operationally said retaining member is placed into a locked state by applying a hammer force from said hammer head to said portion adaptable to be manually struck by said hammer head directionally toward said form mold interface portion mating surface that is positioned adjacent to the form mold, said hammer force is applied upon said leg substantially parallel to said longitudinal axis causing said retaining member to pivot about said form mold interface portion resulting in said lengthwise axis and said longitudinal axis forming an acute angle of about eighty (80) degrees and wherein said mating surface portion is positioned to be perpendicular to said beam longitudinal axis when said slidable engagement is transformed into a substantially locked engagement at a selected location on said beam along said longitudinal axis, further operationally said retaining member is placed back into said free state from said locked state by applying a hammer force from said hammer head to said head portion directionally away from said form mold interface portion substantially parallel to said longitudinal axis thus changing said acute angle to said substantially perpendicular relationship as between said longitudinal axis and said lengthwise axis;

(b) positioning said retainer apparatus such that said pair of form mold interface mating surface portions are each adjacent to a selected location on the form mold; and (c) securing said retainer apparatus into a locked state by placing said retaining members each into a locked state by applying a hammer force from said hammer head to said portion adaptable to be manually struck by said hammer head directionally toward said form mold interface portion mating surface that is positioned adjacent to the form mold, said hammer force is applied upon each said leg substantially parallel to said longitudinal axis causing each of said retaining members to pivot about said form mold interface portion resulting in said lengthwise axis and said longitudinal axis forming said acute angle of about eighty (80) degrees and wherein said mating surface portion is positioned to be perpendicular to said beam longitudinal axis when said slidable engagement is transformed into a substantially locked engagement at a selected location on said beam along said longitudinal axis, resulting in the form mold being retained in a selected position.

5. A method for retaining a form mold in a selected position according to claim 4 further comprising a step of placing said retaining member back into said free state from said locked state by applying a hammer force from said hammer head to said head portion directionally away from said form mold interface portion substantially along said longitudinal axis thus changing said acute angle to said substantially perpendicular relationship as between said longitudinal axis and said lengthwise axis, resulting in said retaining member having free movement along said longitudinal axis at said slidable engagement interface, allowing said retainer apparatus to be removed from the form mold.

* * * * *